US009665116B1

(12) United States Patent
Arnold et al.

(10) Patent No.: US 9,665,116 B1
(45) Date of Patent: May 30, 2017

(54) LOW VOLTAGE CURRENT MODE BANDGAP CIRCUIT AND METHOD

(71) Applicant: Texas Instruments Deutschland GmbH, Freising (DE)

(72) Inventors: Matthias Arnold, Zolling (DE); Asif Qaiyum, Freising (DE)

(73) Assignee: TEXAS INSTRUMENTS DEUTSCHLAND GMBH, Freising (DE)

( * ) Notice: Subject to any disclaimer, the term of this patent is extended or adjusted under 35 U.S.C. 154(b) by 0 days.

(21) Appl. No.: 14/942,460

(22) Filed: Nov. 16, 2015

(51) Int. Cl.
*G05F 3/30* (2006.01)
*G05F 3/16* (2006.01)

(52) U.S. Cl.
CPC ..... *G05F 3/16* (2013.01)

(58) Field of Classification Search
CPC ..... G05F 3/16; G05F 3/30
See application file for complete search history.

(56) References Cited

U.S. PATENT DOCUMENTS

| | | | | |
|---|---|---|---|---|
| 7,411,443 | B2 * | 8/2008 | Ivanov | G05F 3/30 327/539 |
| 7,486,065 | B2 * | 2/2009 | Lin | G05F 3/30 323/313 |
| 7,495,505 | B2 * | 2/2009 | Chang | G05F 3/30 323/313 |
| 8,283,974 | B2 * | 10/2012 | Chu | G05F 3/30 327/539 |
| 8,547,165 | B1 * | 10/2013 | Bernardinis | G05F 3/30 327/513 |
| 2009/0256623 | A1 * | 10/2009 | Tajima | G05F 3/30 327/512 |

* cited by examiner

*Primary Examiner* — Jeffrey Zweizig
(74) *Attorney, Agent, or Firm* — John R. Pessetto; Charles A. Brill; Frank D. Cimino

(57) ABSTRACT

A proportional to absolute temperature (PTAT) generator generates a current PTAT (IPTAT) and a fractional VBE in a first regulation loop. A level shifting voltage-to-current converter is arranged as a second regulation loop and is operable to generate a current ZTC (IZTC) and/or a voltage ZTC (VZTC). Both regulation loops are nested into each other. In an embodiment, the voltage-to-current converter is operable to sum a scaled voltage PTAT (VPTAT/Y) with the fractional VBE (VBE/X) to generate the ZTC signal. In another embodiment, the voltage-to-current converter is operable to sum a delta voltage threshold (ΔVTH) with the fractional VBE (VBE/X) to generate the ZTC signal.

15 Claims, 6 Drawing Sheets

LOW VOLTAGE CURRENT MODE BANDGAP CIRCUIT AND METHOD

BACKGROUND

Many applications of integrated circuits require the integrated circuits to work from low supply voltages and to consume relatively low amounts of power. Many, if not most, of these the integrated circuits incorporate a bandgap reference circuit to provide a constant voltage reference. Such bandgap reference circuits are typically required to have capability to generate accurate reference voltages even at low supply voltages. However, providing accurate reference voltages even with low supply power often requires using large resistors that occupy large areas of the band reference circuits, which increases costs.

SUMMARY

The problems noted above can be addressed in a proportional to absolute temperature (PTAT) generator that generates a PTAT current (IPTAT) and a fractional VBE (voltage base-to-emitter) in a first regulation loop. A voltage-to-current converter is arranged as a second regulation loop and is operable to generate a zero temperature coefficient (ZTC) current (IZTC) and/or a ZTC voltage (VZTC). In an embodiment, the voltage-to-current converter is operable to sum a scaled voltage PTAT (VPTAT/Y) with the fractional VBE (VBE/X) to generate the ZTC signal. In another embodiment, the voltage-to-current converter is operable to sum a voltage threshold difference (ΔVTH) with the fractional VBE (VBE/X) to generate the ZTC signal.

This Summary is submitted with the understanding that it is not be used to interpret or limit the scope or meaning of the claims. Further, the Summary is not intended to identify key features or essential features of the claimed subject matter, nor is it intended to be used as an aid in determining the scope of the claimed subject matter.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be example of that embodiment, and not intended to intimate that the scope of the disclosure, including the claims, is limited to that embodiment.

Certain terms are used throughout the following description—and claims—to refer to particular system components. As one skilled in the art will appreciate, various names may be used to refer to a component or system. Accordingly, distinctions are not necessarily made herein between components that differ in name but not function. Further, a system can be a sub-system of yet another system. In the following discussion and in the claims, the terms "including" and "comprising" are used in an open-ended fashion, and accordingly are to be interpreted to mean "including, but not limited to . . . ." Also, the terms "coupled to" or "couples with" (and the like) are intended to describe either an indirect or direct electrical connection. Thus, if a first device couples to a second device, that connection can be made through a direct electrical connection, or through an indirect electrical connection via other devices and connections. The term "portion" can mean an entire portion or a portion that is less than the entire portion. The term "input" can mean either a source or a drain (or even a control input such as a gate where context indicates) of a PMOS (positive-type metal oxide semiconductor) or NMOS (negative-type metal oxide semiconductor) transistor. The term "mode" can mean a particular architecture, configuration (including electronically configured configurations), arrangement, application, and the like, for accomplishing a purpose. The term "processor" can mean a circuit for processing, a state machine and the like for execution of programed instructions for transforming the processor into a special-purpose machine, circuit resources used for the processing, and combinations thereof.

Figure 1:
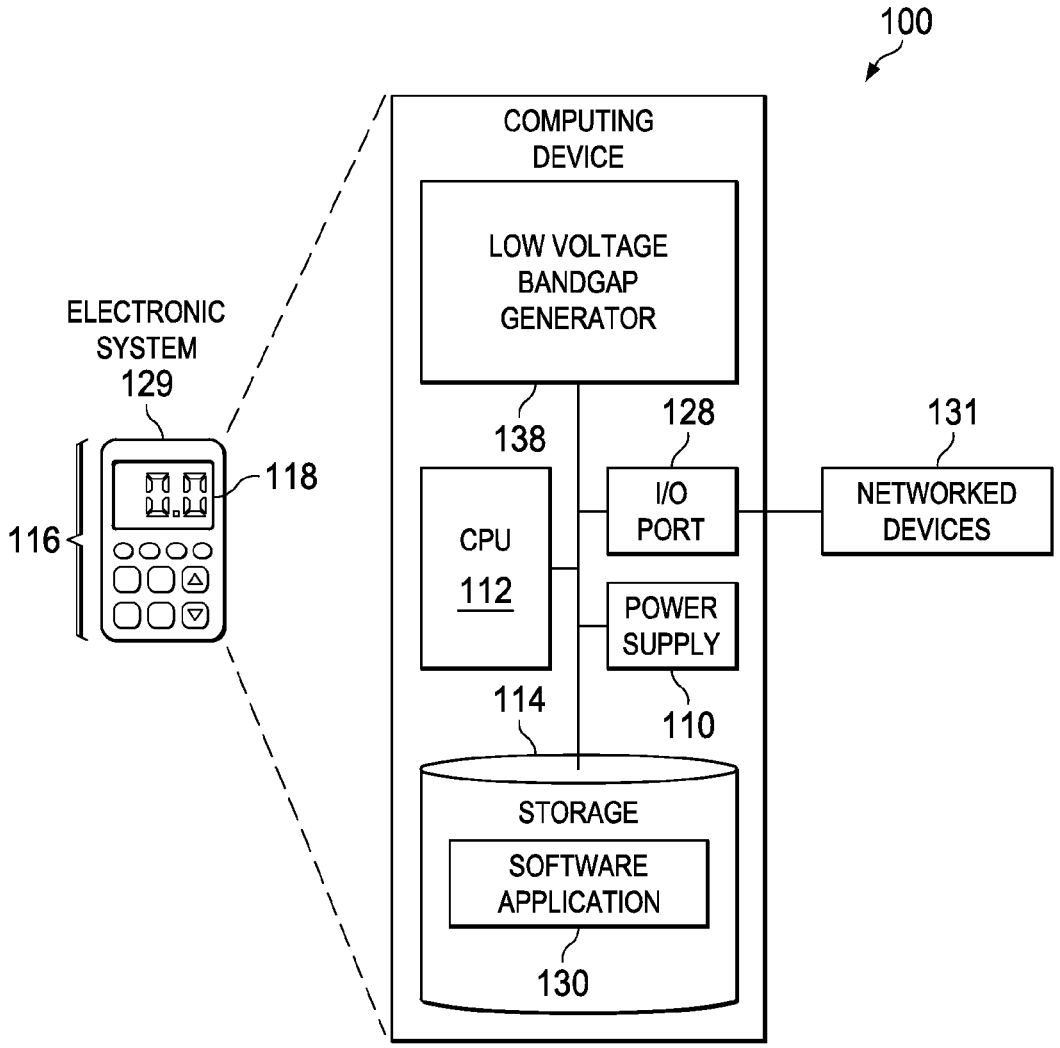
FIG. 1 shows an illustrative electronic device in accordance with example embodiments of the disclosure.

FIG. 1 shows an illustrative computing system 100 in accordance with certain embodiments of the disclosure. For example, the computing system 100 is, or is incorporated into, an electronic system 129, such as a computer, electronics control "box" or display, communications equipment (including transmitters), or any other type of electronic system arranged to generate electrical signals.

In some embodiments, the computing system 100 comprises a megacell or a system-on-chip (SoC) which includes control logic such as a CPU 112 (Central Processing Unit), a storage 114 (e.g., random access memory (RAM)) and a power supply 110. The CPU 112 can be, for example, a CISC-type (Complex Instruction Set Computer) CPU, RISC-type CPU (Reduced Instruction Set Computer), MCU-type (Microcontroller Unit), or a digital signal processor (DSP). The storage 114 (which can be memory such as on-processor cache, off-processor cache, RAM, flash memory, or disk storage) stores instructions for one or more software applications 130 (e.g., embedded applications) that, when executed by the CPU 112, perform any suitable function associated with the computing system 100.

The CPU 112 comprises memory and logic circuits that store information frequently accessed from the storage 114. The computing system 100 is often controlled by a user using a UI (user interface) 116, which provides output to and receives input from the user during the execution the software application 130. The output is provided using the display 118, indicator lights, a speaker, vibrations, and the like. The input is received using audio and/or video inputs (using, for example, voice or image recognition), and electrical and/or mechanical devices such as keypads, switches, proximity detectors, gyros, accelerometers, and the like. The CPU 112 is coupled to I/O (Input-Output) port 128, which provides an interface operable to receive input from (and/or provide output to) networked devices 131. The networked devices 131 can include any device capable of point-to-point and/or networked communications with the computing system 100. The computing system 100 can also be coupled to peripherals and/or computing devices, including tangible, non-transitory media (such as flash memory) and/or cabled or wireless media. These and other input and output devices are selectively coupled to the computing system 100 by external devices using wireless or cabled connections. The storage 114 can be accessed by, for example, by the networked devices 131.

The CPU 112 is coupled to I/O (Input-Output) port 128, which provides an interface operable to receive input from (and/or provide output to) peripherals and/or computing devices 131, including tangible (e.g., "non-transitory") media (such as flash memory) and/or cabled or wireless media (such as a Joint Test Action Group (JTAG) interface). These and other input and output devices are selectively coupled to the computing system 100 by external devices using or cabled connections. The CPU 112, storage 114, and power supply 110 can be coupled to an external power supply (not shown) or coupled to a local power source (such as a battery, solar cell, alternator, inductive field, fuel cell, capacitor, and the like).

The computing system 100 includes a low voltage current mode bandgap generator 138 for generating bandgap (e.g., temperature-independent) current and/or voltage references. The disclosed bandgap reference architecture is capable of working over a wide supply voltage range that is, for example, as low as a selected VZTC plus the VDS (voltage drain-to-source) of transistor P507 (e.g., around 100-200 mV).

The disclosed supply voltage bandgap voltage reference generator 138 typically requires half the resistance (e.g., by eliminating a large-area resistor commonly used in conventional bandgap voltage reference generators) while achieving temperature-independent reference voltages while providing a with the new bandgap core structure (e.g., arrangement of bipolar transistors and resistors) that quickly and reliably achieves a stable operating point. An operating point is a point (e.g., for a given set of selected values of components of a circuit) in which a stable operating voltage is achieved by the circuit. A valid (e.g., correct) operating point is a point at which the circuit operates in accordance with its intended function. (Accordingly, an operating point can be valid or invalid depending on context.)

Figure 2:
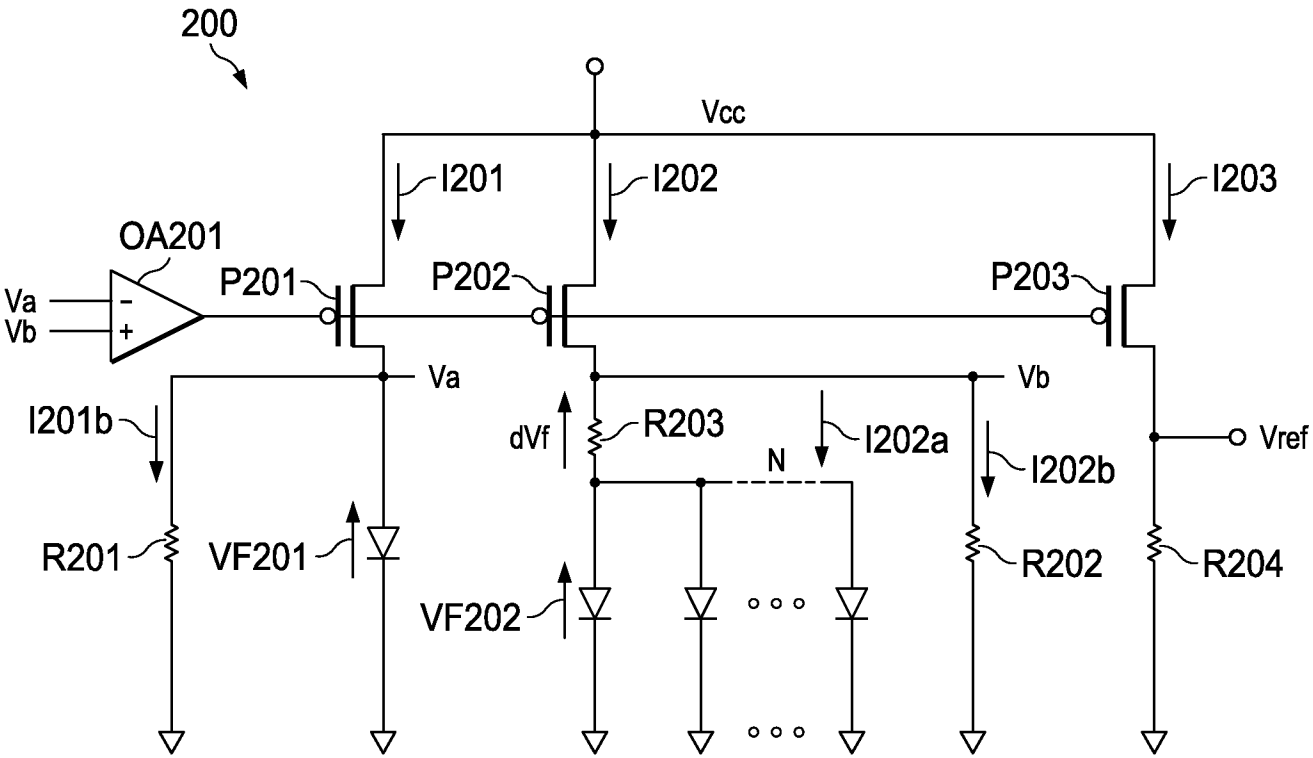
FIG. 2 (PRIOR ART)
FIG. 2 is a schematic of a prior art bandgap circuit 200 having a Banba architecture.

FIG. 2 is a schematic of a bandgap circuit 200 having a "Banba" architecture. The bandgap circuit 200 includes PMOS transistors P201, P202, and P203, and resistors R201, R202, R203, and R204. In operation, a current controlled by PMOS transistor P201 generates the current I201, which in turn generates voltage Va in accordance with the current-density-dependent voltage drop VF201 and the current I201*b* (flowing through resistor R201). In a similar manner, PMOS transistor P202 generates the current I202, which in turn generates voltage Vb in accordance with the current-density-dependent voltage drop VF202 (which is related to the current I202*a*) and the current I202*b* (flowing through resistor R202). The current densities cause VF201 and VF202 to differ in accordance in with the number of N diodes sourced by PMOS transistor P202. The voltages Va and Vb drive a differential amplifier, which generates a temperature-independent control signal for driving the PMOS transistors P202, P202, and P203. A temperature-independent voltage Vref is output in accordance with the current I203 (generated by PMOS transistor P203) and resistor 8204.

The Banba bandgap architecture operates in a current (e.g., flow) domain (as compared to the voltage domain in which bandgap circuit 300 operates). The Banba bandgap architecture generates a constant voltage by adding the delta VBE dependent current to a correct proportion of the VBE dependent current and passing it through a similar type resistor by which VBE and ΔVBE current has been generated. The minimum voltage supply (Vdd) required to operate the Banba bandgap architecture is VBE+Vdsat. For example, when the bipolar transistor has a VBE of 0.8V and the PMOS control transistor has a Vdsat of 0.1V, the minimum operating Vdd is approximately 0.9V.

However, the Banba bandgap architecture operates with higher inaccuracies that result from the current mirroring used to generate the reference voltage. Further, such inaccuracies progressively become even greater as the Vdsat is decreased and as increasingly deeper sub-micron processes are used. The Banba bandgap architecture also has multiple operating points and might not reach a correct operating point without additional control circuitry and a very low operational amplifier offset. The offset of the operational amplifier is reduced to a relatively very low amount by using relatively large transistor areas within the operational amplifier OA201 as well as P201 and P202 (e.g., which increases costs).

Figure 3:
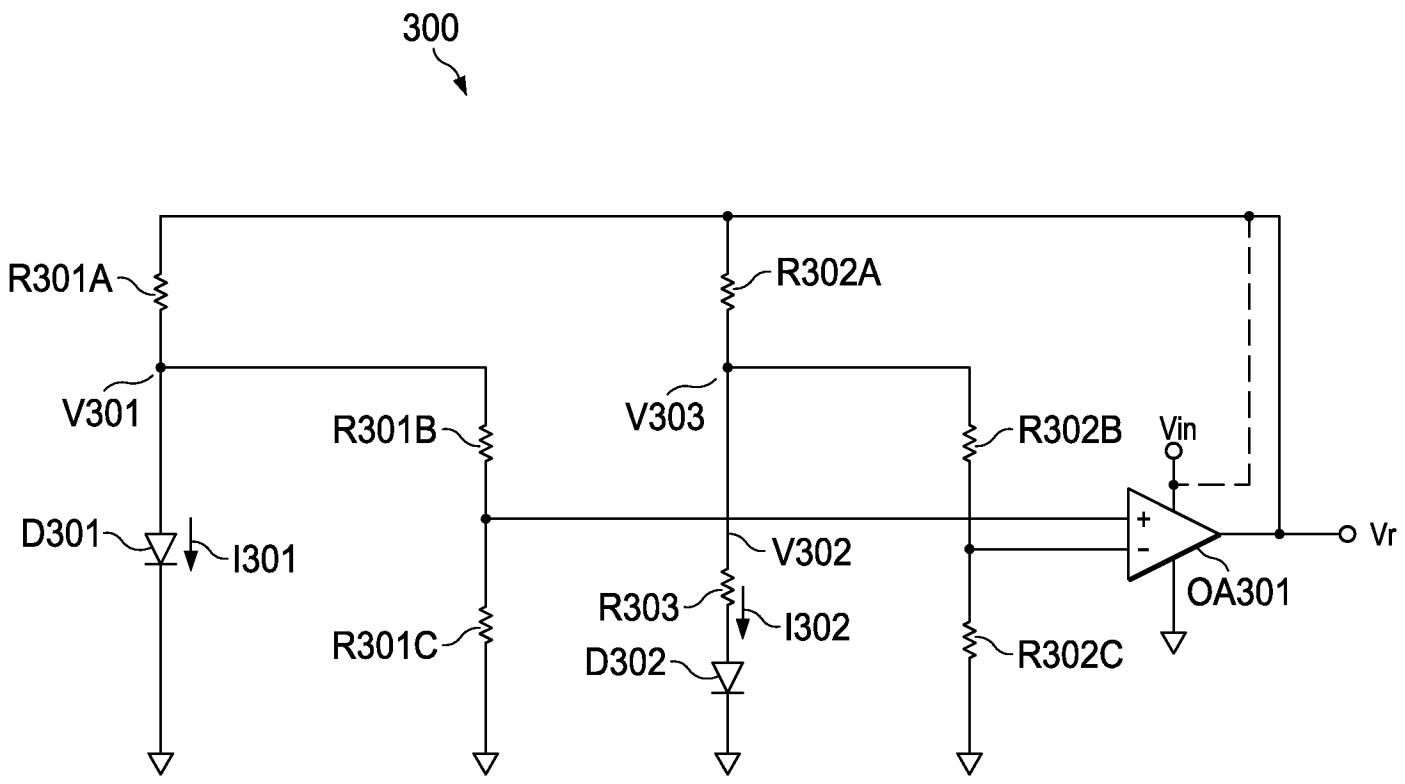
FIG. 3 (PRIOR ART)
FIG. 3 is a schematic of a prior art bandgap circuit 300 having a Hazucha architecture.

FIG. 3 is a schematic of a bandgap circuit 300 having a "Hazucha" architecture. The bandgap circuit 300 includes diodes D301, D302, resistors R301A, R301B, R301C, R302A, R302B, R202C, and R303. In operation, voltage V301 is generated in accordance with the current I301 (e.g., sourced from resistor R301A) and the current-density-dependent voltage drop across diode D301. The voltage V301 is divided by resistors R301B and R301C to generate voltage 302, which is coupled to a non-inverting input of operational amplifier 301. The voltage V303 is generated in accordance with the current I302 (e.g., sourced from resistor R302A) and the current-density-dependent voltage drop across diode D302. The voltage V303 is divided by resistors R302B and R302C to generate a voltage coupled to an inverting input of the operational amplifier OA301. The current densities cause of diode D301 and D302 to differ in accordance in with the ratio of respective aspect ratios of the active area of the diodes D301 and D302. The operational amplifier generates a temperature-independent voltage Vr. The bandgap circuit 300 does not provide a PTAT; instead, the bandgap circuit 300 generates a ZTC reference.

The Hazucha bandgap architecture operates in a voltage domain. The Hazucha bandgap architecture generates a constant voltage by generating Vr such that a fraction of VBE is equal to a fraction of the sum of VBE and VPTAT.

However, the Hazucha bandgap architecture typically requires a relatively large resistor area when operating in low power applications. Likewise, such inaccuracies progressively become even greater as the Vdsat is decreased and as increasingly deeper sub-micron processes are used. The Hazucha bandgap architecture does not output a current that is proportional to absolute temperature (IPTAT) and entails increased costs by using relatively large resistors R301A, R301B, R301C, R302A, R302B, R202C.

Figure 4:
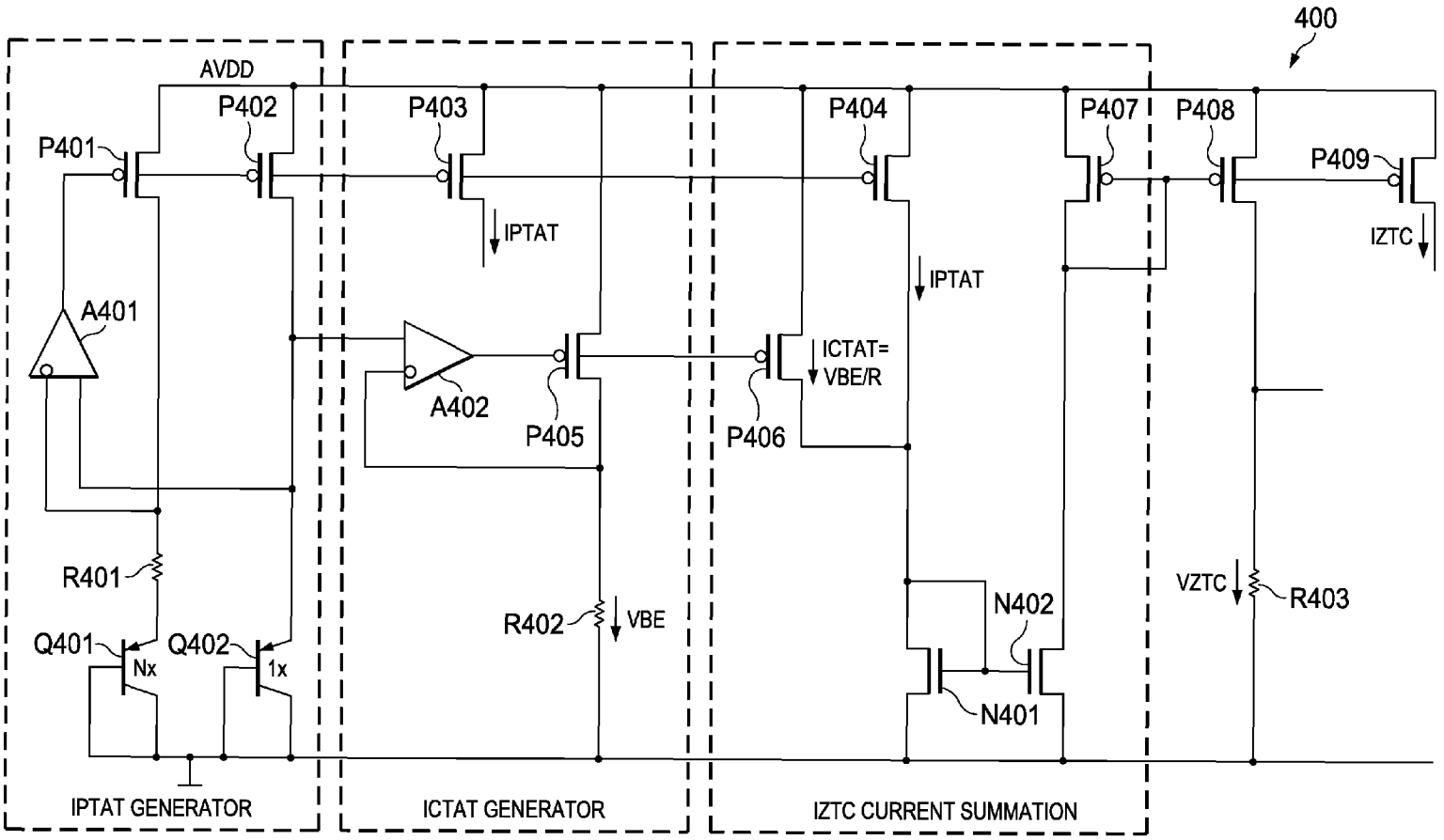
FIG. 4 (PRIOR ART)
FIG. 4 is a schematic of a prior art bandgap circuit 400 having a current summation architecture.

FIG. 4 is a schematic of a prior art bandgap circuit 400 having a current summation architecture. The bandgap circuit 400 includes an IPTAT (current proportional to absolute temperature) generator, an ICTAT (current complementary to absolute temperature) generator, and an IZTC (current with zero temperature coefficient) current summation circuit. The IPTAT generator includes a feedback control loop, which includes bipolar transistors Q401 and Q402 (having different current densities in accordance with ratio N), resistor R401, operational amplifier A401, and PMOS transistors P401 and P402. The ICTAT generator includes a feedback control loop, which includes resistor R402 and R403, operational amplifier A402, and PMOS transistors P403 and P405, where transistor P403 generates the IPTAT current under control of the output of the IPTAT generator operational amplifier A401. The IZTC current generator includes PMOS transistor P406 (for generating an ICTAT in response to the output of the operational amplifier A402 of the ICTAT generator), transistor P404 (for generating an ICTAT in response to the output of the IPTAT generator operational amplifier A401), NMOS transistors N401 and N402 (for mirroring the sum of the ICTAT and IPTAT, which summation is an IZTC) and PMOS transistor P407 and P408 for mirroring the IZTC. Resistor R403 converts IZTC to a zero temperature coefficient voltage (VZTC) whereas PMOS transistor P409 outputs IZTC under control of the current mirror formed by the PMOS transistors PMOS 407 and 408.

However, the current summation (e.g., via transistor N401) circuit 400 is unregulated, which results in a low power supply rejection ratio and susceptibility to improper and/or imprecise operation due to (e.g., manufacturing) process variations.

Figure 5:
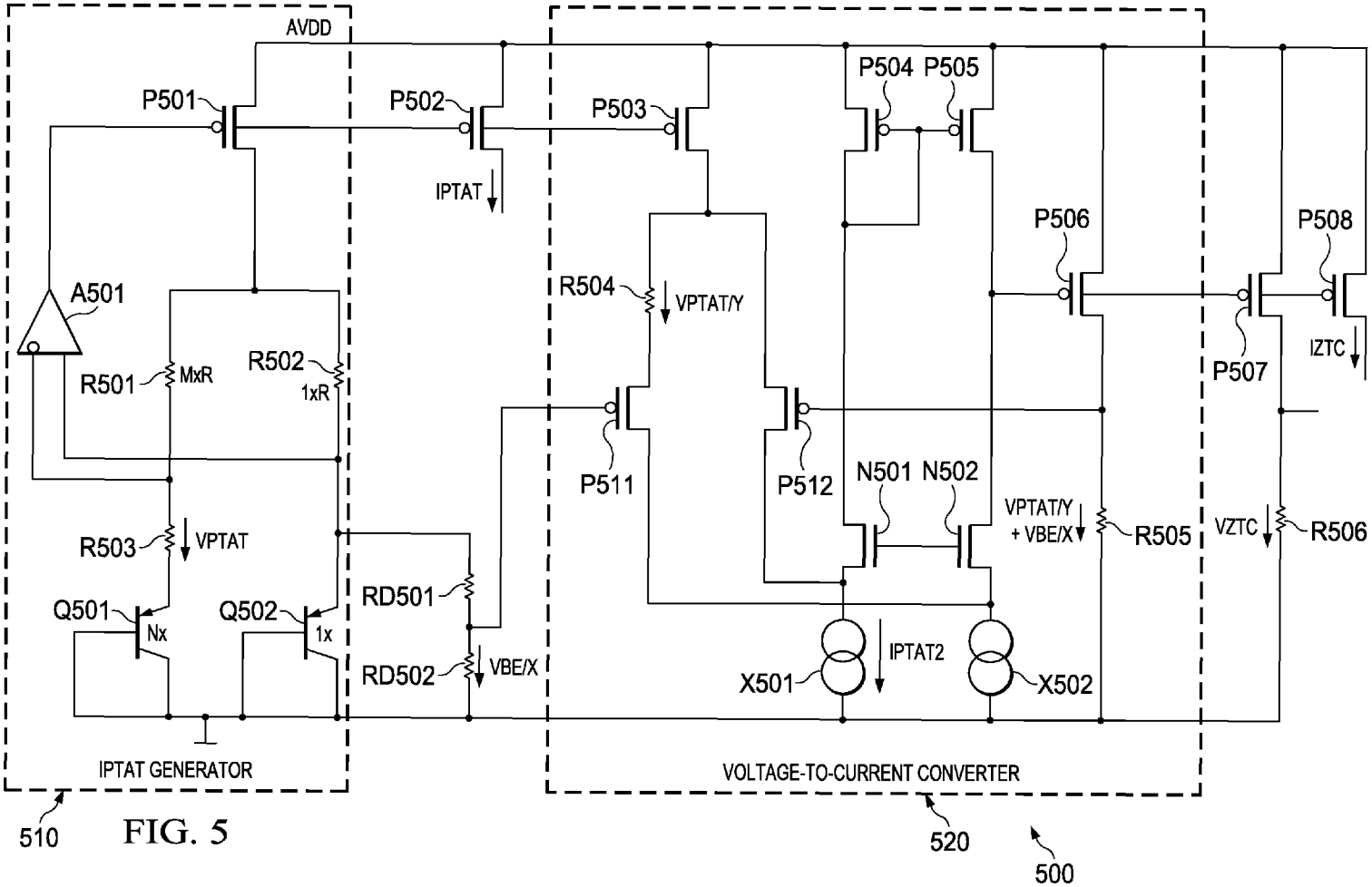
FIG. 5 is a schematic of a low voltage current mode bandgap circuit 500 having VPTAT/Y level shifting in accordance with embodiments of the disclosure.

FIG. 5 is a schematic of a low voltage current mode bandgap circuit 500 in accordance with embodiments of the disclosure. The bandgap circuit 500 includes an IPTAT (current proportional to absolute temperature) generator 510 and a voltage-to-current converter 520.

The IPTAT generator 510 includes (e.g., first) feedback circuitry including a first feedback control loop. The IPTAT generator 510 includes bipolar transistors Q501 and Q502, resistors R501, R502, and R503, operational amplifier A501, and PMOS transistor P501. Transistor P501 has a gate coupled to the output of the operational amplifier 501, a source coupled to an analog supply (AVDD), and a drain coupled to an IPTAT generator 510 common node for dividing a (e.g., IPTAT) current.

In operation of the IPTAT generator 510, the transistor P501 generates a first regulated current (e.g., an IPTAT in response to a feedback control signal), which is coupled to the IPTAT generator 510 common node. The first regulated current (e.g., sourced from the drain of the transistor P501) is shared (e.g., divided) between a first current branch flowing through resistor R501 and a second current branch flowing through resistor R502. The proportion of current division is determined in accordance with a ratio of the respective resistance values of R501 and R502, the emitter ratio (e.g., Nx) of Q501 to Q502 (e.g., which operate having mutually different current densities in accordance with the emitter ratio), and the resistance of R503. Accordingly, a first shared IPTAT-sourced current is proportionately varied as a function of temperature of a PN junction of bipolar transistor Q501 and a second shared IPTAT-sourced current is inversely varied as a function of temperature by a PN junction of bipolar transistor Q502.

For example (and assuming a stable operating point has been reached), an increase in temperature causes transistor Q501 (which has a proportionately larger emitter area than Q502) to draw more current, which increases the amount of current of the first shared IPTAT-sourced current. Because of the sharing of the ITPAT current, the amount of current in the second shared IPTAT-sourced current becomes correspondingly and increasingly smaller as temperature increases (e.g., because less current is available for sharing). The increase in the proportion of the first and second shared IPTAT-sourced current causes a voltage rise in a first emitter control signal (e.g., generated at a center node of a voltage divider formed by resistor R501 coupled in series with resistor R503 and varied by the emitter of transistor Q501). In a similar fashion, the increase in the proportion of the first and second shared IPTAT-sourced currents causes a voltage drop in a second emitter control signal (e.g., varied by the emitter of transistor Q502). Accordingly, the second emitter control signal typically has a temperature coefficient that is opposite (e.g., complementary) to the temperature coefficient of the first emitter control signal.

In a similar example, a decrease in temperature causes a voltage drop in the first emitter control signal and a rise in the second emitter control signal (e.g., because the first shared IPTAT-sourced current progressively conducts less current and the second shared IPTAT-sourced current progressively conducts more current).

The relative resistance values of R501, R502 and R503 are selectively chosen such that a stable operating point is reached over a range of (e.g., increasing and decreasing) temperatures. For example, the resistance value of R501 is M times larger than the resistance value of R502, where M is also in accordance with the emitter area (e.g., emitter current) ratio N, where M is independent of N (although, for example, the values of N and M, the emitter areas, and R503 determine the amount of IPTAT through P501).

The first and second emitter control signals are respectively coupled to the first (e.g., inverting) input and the second (non-inverting) input of the operational amplifier A501. The operational amplifier A501 (e.g., in response to the voltage difference between the first and second emitter control signals) generates (e.g., outputs) a first feedback (e.g., loop) control signal for driving the gates of transistors P501, P502, and P503. Accordingly, a first feedback control loop is formed which, includes the components P501, R501, R502, and A501. The first feedback control loop, for example, ensures that the IPTAT (current) sourced by transistor P501 equalizes the first and second emitter control signals, which results in the temperature characteristic of IPTAT, which is proportional to absolute temperature.

The transistor P502 is operable to generate an IPTAT in response to the first feedback control signal (e.g., being coupled to the gate of the transistor P502). The transistor P502 is operable to generate an IPTAT in response to the first feedback control signal in a manner similar to transistors P501 and P503, where the respective sources are coupled to the analog supply and the respective drains are coupled to respective circuitry for receiving an IPTAT.

The second emitter control signal, which is a base-to-emitter voltage (VBE) of transistor Q502, is applied to a voltage divider (comprising resistors RD501 and RD502), which in turn is operable to generate a fractional VBE (VBE/X) in accordance with a proportion X determined by the values of RD501 and RD502. The amount of current drawn by the voltage divider (comprising resistors RD501 and RD502) is selected to be relatively negligible with respect to the (e.g., much larger) current flowing between the emitter and collector of transistor Q502. The fractional VBE is regulated by the first feedback control loop (e.g., the VBE is used as an input to the amplifier A501). The fractional VBE has a temperature coefficient that is CTAT (e.g., having a complementary polarity to the temperature coefficient of the VPTAT, the VPTAT being generated across resistor R503). The fractional VBE (as compared with the full-scale VBE), for example, allows lower voltage operation of the voltage-to-current converter 520 as well as allows a lower output voltage VZTC of the voltage-to-current converter 520.

The voltage-to-current converter 520 includes (e.g., second) feedback circuitry including a differential amplifier as a portion of the second feedback control loop. The voltage-to-current converter 520 includes resistor R504, NMOS transistors N501 and N502, current sinks X501 and X502, and PMOS transistors P503, P504, P505, P506, P511, and P512. The differential amplifier has two stages. The first stage (which includes components P503, P511, P512, R504, P504, P505, N501, N502, X501, X502) is arranged having an input differential pair (which includes transistors P511 and 512 and, in an embodiment, resistor R504) and a current mirror section (which includes transistors P504, P505, N501, and N502, and current sinks X501 and X502). The second stage includes transistor P506. The second stage drives resistor R505, which conducts the current converted from the voltage across the input differential pair. Transistors P507 and P508 conduct a copy of the converted current through P506 and R505. The current through R506 generates a zero temperature current (ZTC) voltage (VZTC) in accordance with the current ratio defined by P506 and P507 as well as the resistor ratio between R505 and R506. The transistor P508 provides a current IZTC, which can be used to bias other circuits using a temperature-independent current reference.

In operation of the voltage-to-current converter 520, the transistor P503 generates a regulated copy of the current flowing through P501 (e.g., an IPTAT in response to a feedback control signal). The regulated copy of the IPTAT (which is an IPTAT in and of itself) is coupled to common node (e.g., at the drain of P503) at which the IPTAT is divided. The commonly sourced IPTAT current (e.g., sourced from the drain of the transistor P503) is shared (e.g., divided) between a first input side (of the input section) of the differential amplifier and a second input side (of the input section) of the differential amplifier. The input section is operable to actively couple (e.g., amplify) the input signals of the differential amplifier, which is arranged in a folded cascode amplifier configuration. In operation as an amplifier, both gate signals of P511 and P512 are regulated to be equal in accordance with: VG(P511)=VBE/X+V(R504)=VBE/X+VPTAT/Y and VG(P512)=V(R505), where VG is a gate voltage. Because VG(P512) is coupled to R505 the voltage across R505 is controlled by P506 such that V(R505)=VG(P511)=VBE/X+V(R504)=VBE/X+VPTAT/Y.

The first input side (of the input differential pair) includes, for example, resistor R504 and transistor P511. The current flowing through the first input side is determined in response to various factors such as the portion of the second regulated IPTAT current flowing through the resistor R504, the value of the resistor R504; and the fractional VBE (VBE/X).

A signal quantity VPTAT/Y is developed across the resistor R504 and is, accordingly, a scaled VPTAT signal. The value of Y is determined in accordance with the ratio of R503 and R504 as well as the current mirror ratios of P501 and P503. The value of resistor R504 is selected to "level-shift" (e.g., scale) the voltage of the VPTAT signal developed in response to the IPTAT generated by transistor P503. The value of resistor R504 is selected in accordance with the level-shifting value Y, which in turn is determined such that the summation of (e.g., contemporaneous) the signal quantities of VPTAT/Y and VBE/X is a constant over a selected range of operating temperatures.

The signal quantity VBE/X is coupled to the gate of input transistor P511, which provides a first differential input control signal having a CTAT temperature coefficient, such that temperature-caused variations of signal quantities of VPTAT/Y and VBE/X substantially and mutually cancel at each instant of time and temperature during normal operation. The current flowing through the first input side of the differential amplifier of voltage-to-current converter 520 is coupled to an output side of the current mirror section of the voltage-to-current converter 520.

The second input side of the differential amplifier includes, for example, transistor P512. The current flowing through the second input side is determined in response to various factors such as the second (e.g., remaining) portion of the IPTAT current generated at the drain of transistor P503 (e.g., the portion of divided said current not flowing through resistor R504), the voltage developed at the drains of P505 and N502 and coupled to the gate of transistor P506, and the value of resistor R505. A voltage having a value of the sum of VPTAT/Y and VBE/X is developed across the resistor R505 and is coupled to the gate of input transistor P512, which provides a second differential input control signal having a zero temperature coefficient voltage (VZTC).

The value of resistor R504 is selected such that the summation of contemporaneous signal quantities of VPTAT/Y and VBE/X is a constant over a range of operating temperatures. The current flowing through the second input side of the differential amplifier of voltage-to-current converter 520 is coupled to a control side of a mirror section (discussed below) of the differential amplifier of voltage-to-current converter 520.

The mirror section of the differential amplifier of voltage-to-current converter 520 includes an output side and a control side. The output side of the mirror section includes the PMOS transistor P505, NMOS transistor N502, and a current sink X502 operable to sink an IPTAT2 current (e.g., a current having a flow developed in response to the first feedback control signal of IPTAT generator 510). The input side of the mirror section includes the PMOS transistor P504, NMOS transistor N501, and a current sink X501 operable to sink an IPTAT2 current (e.g., a current having a flow developed in response to the first feedback control signal of IPTAT generator 510). The transistors P504 and P505 are arranged in a current mirror configuration such that the current flowing through transistor P504 (of the control side) is substantially equal to the current flowing through transistor P505 (of the output side).

Accordingly, a second feedback control loop is formed in feedback circuitry of the voltage-to-current converter 520, which traverses the components R504, P511, N502, P506, and P512. The second feedback control loop, for example, helps ensure the summation of VPTAT/Y and VBE/X is well regulated, which provides greater power supply rejection ratios over many conventional solutions. The disclosed architecture, for example, is self-biasing and suited for low voltage operation (e.g., less than 1.2 volts).

The differential amplifier output includes a first stage and a second stage. The output of the first stage is arranged at the drain of transistor P505. The output of the differential amplifier (e.g., at the drain of transistor P506) is a VZTC (voltage having a zero temperature coefficient). Accordingly, an output VZTC signal is generated the drain of transistor P507, which replicates the voltage developed across resistor R505 and scales the replicated voltage in accordance with the value of resistor R506. An IZTC is generated by mirroring and scaling the current flowing through the drain of transistor P508.

Figure 6:
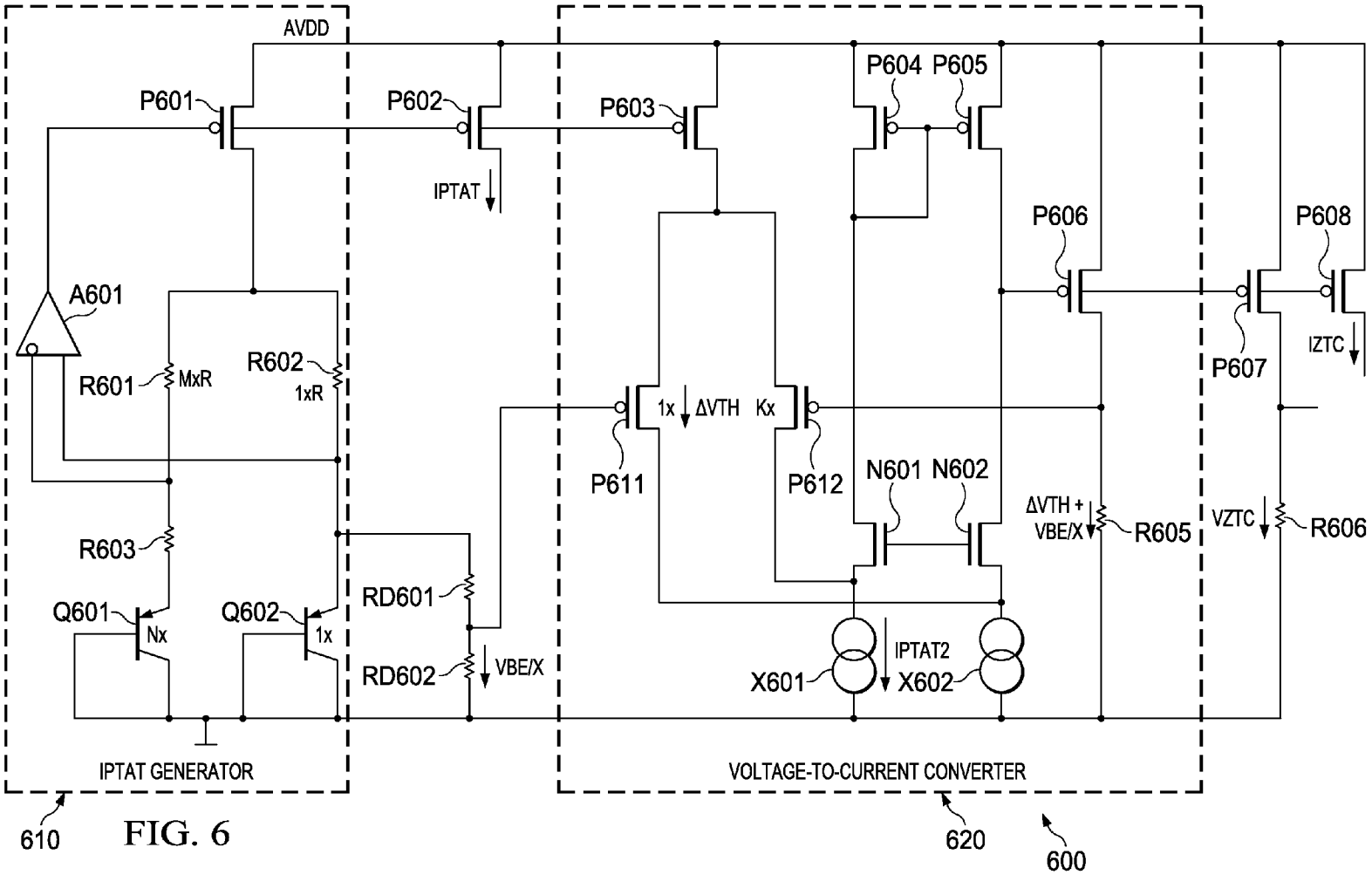
FIG. 6 is a schematic of a low voltage current mode bandgap circuit 600 having ΔVTH level shifting in accordance with embodiments of the disclosure.

FIG. 6 is a schematic of a low voltage current mode bandgap circuit 600 in accordance with embodiments of the disclosure. The bandgap circuit 600 includes an IPTAT (current proportional to absolute temperature) generator 610 and a voltage-to-current converter 620.

The IPTAT generator 610 includes (e.g., first) feedback circuitry including a first feedback control loop. The IPTAT generator 610 includes bipolar transistors Q601 and Q602, resistors R601, R602, and R603, operational amplifier A601, and PMOS transistor P601. Transistor P601 has a gate coupled to the output of the operational amplifier 601, a source coupled to an analog supply (AVDD), and a drain coupled to an IPTAT generator 610 common node for dividing a (e.g., IPTAT) current.

In operation of the IPTAT generator 610, the transistor P601 generates a first regulated current (e.g., an IPTAT in response to a first feedback control signal), which is coupled to the IPTAT generator 610 common node. The first regulated current (e.g., sourced from the drain of the transistor P601) is shared (e.g., divided) between a first current branch flowing through resistor R601 and a second current branch flowing through resistor R602. The proportion of current division is determined in accordance with a ratio of the respective resistance values of R601 and R602, the emitter ratio (e.g., Nx) of Q601 to Q602 (e.g., which operate having mutually different current densities in accordance with the emitter ratio), and the resistance of R603. Accordingly, a first shared IPTAT-sourced current is proportionately varied as a function of temperature of a PN junction of bipolar transistor Q601 and a second shared IPTAT-sourced current is inversely varied as a function of temperature by a PN junction of bipolar transistor Q602.

For example (and assuming a stable operating point has been reached), an increase in temperature causes transistor Q601 (which has a proportionately larger emitter area than Q602) to draw more current, which increases the amount of current of the first shared IPTAT-sourced current. Because of the sharing of the ITPAT current, the amount of current in the second shared IPTAT-sourced current becomes correspondingly and increasingly smaller as temperature increases (e.g., because less current is available for sharing). The increase in the proportion of the first and second shared IPTAT-sourced current causes a voltage rise in a first emitter control signal (e.g., generated at a center node of a voltage divider formed by resistor R601 coupled in series with resistor R603 and varied by the emitter of transistor Q601). In a similar fashion, the increase in the proportion of the first and second shared IPTAT-sourced currents causes a voltage drop in a second emitter control signal (e.g., varied by the emitter of transistor Q602). Accordingly, the second emitter control signal typically has a temperature coefficient that is opposite (e.g., complementary) to the temperature coefficient of the first emitter control signal.

In a similar example, a decrease in temperature causes a voltage drop in the first emitter control signal and a rise in the second emitter control signal (e.g., because the first shared IPTAT-sourced current progressively conducts less current and the second shared IPTAT-sourced current progressively conducts more current).

The relative resistance values of R601, R602, and R603 are selectively chosen such that a stable operating point is reached over a range of (e.g., increasing and decreasing) temperatures. For example, the resistance value of R601 is M times larger than the resistance values of R602, where M is determined in accordance with the emitter area (e.g., emitter current) ratio N, where M is independent of N (although, for example, the values of N and M, the emitter areas, and R603 determine the amount of IPTAT through P601).

The first and second emitter control signals are respectively coupled to the first (e.g., inverting) input and the second (non-inverting) input of the operational amplifier A601. The operational amplifier A601 (e.g., in response to the voltage difference between the first and second emitter control signals) generates (e.g., outputs) a first feedback (e.g., loop) control signal for driving the gates of transistors P601, P602, and P603. Accordingly, a first feedback control loop is formed which, includes the components P601, R601, R602, and A601. The first feedback control loop, for example, ensures the IPTAT (current) sourced by transistor equalizes the first and second emitter control signals, which results in the temperature characteristic of IPTAT, which is proportional to absolute temperature.

The transistor P602 is operable to generate an IPTAT in response to the first feedback control signal (e.g., being coupled to the gate of the transistor P602). The transistor P602 is operable to generate an IPTAT in response to the first feedback control signal in a manner similar to transistors P601 and P603, where the respective sources are coupled to the analog supply and the respective drains are coupled to respective circuitry for receiving an IPTAT.

The second emitter control signal, which is a base-to-emitter voltage (VBE) of transistor Q602, is applied to a voltage divider (comprising resistors RD601 and RD602), which in turn is operable to generate a fractional VBE (VBE/X) in accordance with a proportion X determined by the values of RD601 and RD602. The amount of current drawn by the voltage divider (comprising resistors RD601 and RD602) is selected to be relatively negligible with respect to the (e.g., much larger) current flowing between the emitter and collector of transistor Q602. The fractional VBE is regulated by the first feedback control loop (e.g., the VBE is used as an input to the amplifier A601). The fractional VBE has a temperature coefficient that is CTAT (e.g., having a complementary polarity to the temperature coefficient of the VPTAT, the VPTAT being generated across resistor R603). The fractional VBE (as compared with the full-scale VBE), for example, allows lower voltage operation of the voltage-to-current converter 620 as well as allows a lower output voltage VZTC of the voltage-to-current converter 620.

The voltage-to-current converter 620 includes (e.g., second) feedback circuitry including a differential amplifier as a portion of a second feedback control loop. The voltage-to-current converter 620 includes NMOS transistors N601 and N602, current sinks X601 and X602, and PMOS transistors P603, P604, P605, P606, P611, and P612.

The differential amplifier has two stages. The first stage (which includes components P603, P611, P612, P604, P605, N601, N602, X601, and X602) is arranged having an input differential pair (which includes transistors P611 and 612) and an current mirror section (which includes transistors P604, P605, N601, and N602, and current sinks X601 and X602). The second stage includes transistor P606. The second stage drives resistor R605, which conducts the current converted from the voltage across the input differential pair. Transistors P607 and P608 conduct a copy of the converted current through P606 and R605. The current through R606 generates a zero temperature current (ZTC) voltage (VZTC) in accordance with the current ratio defined by P606 and P607 as well as the resistor ratio between R605 and R606. The transistor P608 provides a current IZTC, which can be used to bias other circuits using a temperature-independent current reference.

In operation of the voltage-to-current converter 620, the transistor P603 generates a regulated copy of the current flowing through P601 (e.g., an IPTAT in response to a feedback control signal). The regulated copy of the IPTAT (which is an IPTAT in and of itself) is coupled to common node (e.g., at the drain of P603) at which the IPTAT is divided. The commonly sourced IPTAT current (e.g., sourced from the drain of the transistor P603) is shared (e.g., divided) between a first input side (of the input section) of the differential amplifier and a second input side (of the input section) of the differential amplifier. The input section is operable to actively couple (e.g., amplify) the input signals of the differential amplifier, which is arranged in a folded cascode amplifier configuration. The input section is operable to generate a delta-VTH in accordance with a factor Kx, where the delta-VTH is effectively added to the VGS (voltage gate-to-source) of P611 (which, for example, approximates the operation of the R504 of FIG. 5).

The first input side (of the input differential pair) includes, for example, transistor P611. The current flowing through the first input side is determined in response to (e.g., at least) three factors: the second regulated current (e.g., sourced by transistor P603); the fractional VBE (e.g., coupled to the gate of transistor P611); and a portion of the commonly sourced current shared with (e.g., drawn by) the second input side from the voltage-to-current converter 620 common node. The current flowing through the first input side of the differential amplifier of voltage-to-current converter 620 is coupled to an output side of the current mirror (of the differential amplifier) of the voltage-to-current converter 620

The second input side of the differential amplifier of voltage-to-current converter 620 includes, for example, transistor P612. The current flowing through the second input side is determined in response to various factors such as the second (e.g., remaining) portion of the IPTAT current generated at the drain of transistor P603 (e.g., the portion of divided said current not flowing through transistor P611), and the voltage developed at the drains of P605 and N602 and coupled to the gate of transistor P606. The current flowing through the second input side of the differential amplifier of voltage-to-current converter 620 is coupled to a control side of the current mirror (of the differential amplifier) of the voltage-to-current converter 620.

A signal quantity ΔVTH (delta voltage threshold) is developed across transistors P611 and P612. Transistors P611 and P612 are operated in a weak inversion region and are respectively sized such that the gate lengths of P611 and P612 are equal but the width of the gate of transistor P611 is K times greater than transistor P612, where K is approximately equal to the ratio N between transistors Q601 and Q602. (However, the value of K does not necessarily depend on N since P611 and P612 are MOSFETs while Q601 and Q602 are bipolar transistors.) Accordingly, the generated ΔVTH signal substantially approximates the value VPTAT/Y generated in the voltage-to-current generator 520 without requiring the voltage-shifting resistor R504. The ΔVTH signal is generated such that the summation of contemporaneous signal quantities of ΔVTH and VBE/X is a constant over a range of operating temperatures.

In the course of operation as amplifier, both gate signals of P611 and P612 are regulated to be substantially equal in accordance with the relationships VG(P611)=VBE/X and VG(P612)=V(R605). In an input differential pair having substantially equivalent transistor sizes, both VG(P611) and VG(P612) would be forced to be substantially equal. When both P611 and P612 operate in a weak inversion region and have different gate widths in accordance with the factor K, the respective VGS (voltages gate-to-source) differ by a value VTH. This is in accordance with the corresponding principle as disclosed with respect to Q601 and Q602 of the IPTAT generator 610 with the exception that VPTAT is not developed across a resistor. The Kx multiplier (of P612) effectively reduces VGS(P612), which is, in the amplifier configuration, effectively approximates adding the value of VGS(P612) to VGS(P611). Likewise adding the VGS(P612) to VGS(P611) effectively approximates adding the VGS (P612) to the gate voltage of P611. Accordingly, the voltage across R605 is scaled, e.g., voltage shifted, by P606 such that V(R605)=VBE/X+VTH.

The signal quantity VBE/X is coupled to the gate of transistor P611, which provides a first differential input control signal having a CTAT temperature coefficient, such that temperature-caused variations of signal quantities of VPTAT/Y and VBE/X substantially and mutually cancel at each instant of time and temperature during normal operation. The current flowing through the first input side of the differential amplifier of voltage-to-current converter 620 is coupled to an output side of an output stage (discussed below) of the differential amplifier of voltage-to-current converter 620.

The second input side of the differential amplifier of voltage-to-current converter 620 includes, for example, transistor P612. The current flowing through the second input side is determined in response to various factors such as the second (e.g., remaining) portion of the IPTAT current generated at the drain of transistor P603 (e.g., the portion of divided said current not flowing through transistor P611), the voltage developed at the drains of P605 and N602 and coupled to the gate of transistor P606, and the value of resistor R605. A voltage having a value of the sum of VPTAT/Y and VBE/X is developed across the resistor R605 and is coupled to the gate of input transistor P612, which provides a second differential input control signal having a zero temperature coefficient voltage (VZTC). The value of resistor R605 is selected such that the summation of contemporaneous signal quantities of VPTAT/Y and VBE/X is a constant over a range of operating temperatures. The current flowing through the second input side of the differential amplifier of voltage-to-current converter 620 is coupled to a control side of an output stage (discussed immediately below) of the differential amplifier of voltage-to-current converter 620.

The mirror section of the differential amplifier of voltage-to-current converter 620 includes an output side and a control side. The output side of the mirror section includes the PMOS transistor P605, NMOS transistor N602, and a current sink X602 operable to sink an IPTAT2 current (e.g., a current having a flow developed in response to the first feedback control signal of IPTAT generator 610). The input side of the mirror section includes the PMOS transistor P604, NMOS transistor N601, and a current sink X601 operable to sink an IPTAT2 current (e.g., a current having a flow developed in response to the first feedback control signal of IPTAT generator 610). The transistors P604 and P605 are arranged in a current mirror configuration such that a voltage developed by the current flowing through transistor P604 (of the control side) is substantially equal to the current flowing through transistor P605 (of the output side).

Accordingly, a second feedback control loop is formed in the voltage-to-current converter 620, which traverses the components P611, N602, P606, and P612. The second feedback control loop, for example, helps ensure the summation of VTH and VBE/X is well regulated, which provides greater power supply rejection ratios over many conventional solutions. The disclosed architecture, for example, is self-biasing and suited for low voltage operation (e.g., less than 1.2 volts) as discussed above.

The differential amplifier output stage includes a first stage and a second stage. The output of the first stage is arranged at the drain of transistor P605. The second stage includes transistor P606 and resistor R605. The drain of transistor P605 is coupled to the gate of transistor P606, which produces a current in response to the voltage applied to the gate. The current is converted to a voltage, for example, by the resistor R605, where the voltage is the output of the differential amplifier.

The various embodiments described above are provided by way of illustration only and should not be construed to limit the claims attached hereto. Those skilled in the art will readily recognize various modifications and changes that could be made without following the example embodiments and applications illustrated and described herein, and without departing from the true spirit and scope of the following claims.

What is claimed is:

1. A circuit, comprising:

a first amplifier for generating a first control signal in response to a reference voltage proportional to absolute temperature (VPTAT) and a reference base-to-emitter voltage (VBE);

a first transistor for generating a reference current proportional to absolute temperature (IPTAT) in response to the first control signal, wherein the reference VPTAT and the reference VBE are generated in response to the reference IPTAT;

a second amplifier for generating a second control signal in response to the first control signal and the reference VBE; and a second transistor for generating a reference zero temperature coefficient (ZTC) signal in response to the second control signal, wherein the second control signal is generated in response to the reference ZTC signal;

a first resistor having a first terminal coupled to the drain of the first transistor and a second terminal coupled to the first terminal of a second resistor, the second resistor including a second terminal coupled to the emitter of a first bipolar transistor, wherein the reference VPTAT is generated at the second terminal of the first resistor.

2. The circuit of claim 1, comprising a third resistor having a first terminal coupled to the drain of the first transistor and a second terminal coupled to the emitter of a second bipolar transistor, the first and second bipolar transistors being operable at mutually different current densities, wherein the reference VBE is generated at the emitter of a second bipolar transistor.

3. The circuit of claim 2, including a resistor divider operable to generate a fractional VBE in response to the reference VBE.

4. The circuit of claim 3, wherein the second control signal is generated in response to the reference VPTAT and the fractional VBE.

5. The circuit of claim 3, wherein the reference ZTC signal is one of a voltage ZTC and a current ZTC.

6. The circuit of claim 5, wherein the second amplifier includes an IPTAT source transistor operable to generate a converter IPTAT, a scaling resistor operable to generate a scaled VPTAT in response to a portion of the converter IPTAT coupled from the drain of the IPTAT source transistor, and a first differential input transistor having a source coupled to the drain of the IPTAT source transistor and being operable to generate the second control signal in response to the scaled VPTAT and the fractional VBE.

7. The circuit of claim 5, wherein the second amplifier includes an IPTAT source transistor operable to generate a converter IPTAT, a first differential input transistor having a source coupled to the drain of the IPTAT source transistor, a second differential input transistor having a source coupled to the drain of the IPTAT source transistor, the first differential input transistor operable to develop a delta voltage threshold (ΔVTH) with respect to the second differential input transistor and operable to generate the second control signal in response to the ΔVTH and the fractional VBE.

8. The circuit of claim 6, to wherein the second control signal has a CTAT (complementary to absolute temperature) temperature coefficient.

9. The circuit of claim 6, comprising a current mirror operable to sink current from a second differential input transistor having a source coupled to the drain of the IPTAT source transistor in response to the second control signal.

10. The circuit of claim 9, wherein the current mirror is operable to sink current from the second control signal and, in response, to generate a differential amplifier output signal.

11. The circuit of claim 10, comprising an output transistor operable to generate a feedback signal in response to the differential amplifier output signal, wherein the feedback signal is the summation of the scaled VPTAT and the fractional VBE and is coupled to the gate of the second differential input transistor.

12. A system comprising:

a first amplifier for generating a reference current proportional to absolute temperature (IPTAT) and a reference base-to-emitter voltage (VBE), wherein a first input to the first amplifier is generated in response to the reference IPTAT; and a second amplifier for generating a zero temperature coefficient current (IZTC) in response to the reference IPTAT and the reference VBE;

wherein the second amplifier is operable to generate a zero temperature coefficient voltage (VZTC) in response to the IZTC; and a voltage divider that is operable to generate a fractional VBE in response to the VBE, wherein the second amplifier is operable to generate the VZTC by summing the fractional VBE with a scaled voltage proportional to absolute temperature (VPTAT), and wherein the scaled VPTAT is generated by applying the IPTAT to a resistor.

13. A system comprising:

a first amplifier for generating a reference current proportional to absolute temperature (IPTAT) and a reference base-to-emitter voltage (VBE), wherein a first input to the first amplifier is generated in response to the reference IPTAT; and a second amplifier for generating a zero temperature coefficient current (IZTC) in response to the reference IPTAT and the reference VBE;

wherein the second amplifier is operable to generate a zero temperature coefficient voltage (VZTC) in response to the IZTC; and a voltage divider that is operable to generate a fractional VBE in response to the VBE, wherein the second amplifier is operable to generate the VZTC by summing the fractional VBE with a quantity ΔVTH (delta voltage threshold), wherein the ΔVTH is developed across differential input transistors of the second amplifier.

14. A method comprising:

generating a reference current proportional to absolute temperature (IPTAT) in a first feedback circuitry having bipolar transistors, wherein at least two of the bipolar transistors are operable having mutually different current densities, and wherein one of the bipolar transistors generates a reference base-to-emitter voltage (VBE), wherein the reference IPTAT and the reference VBE are coupled as feedback signals in the first feedback circuitry;

generating a zero temperature coefficient current (IZTC) in a second feedback circuitry in response to the reference IPTAT and the reference VBE, wherein the IZTC is coupled as a feedback signal in the second feedback circuitry;

generating a zero temperature coefficient voltage (VZTC) in response to the IZTC; and generating a fractional VBE in response to the VBE, wherein the second feedback circuitry is operable to generate the VZTC by summing the fractional VBE with a scaled voltage proportional to absolute temperature (VPTAT), and wherein the scaled VPTAT is generated by applying the IPTAT to a resistor.

15. The method of claim 14, comprising generating a fractional VBE in response to the VBE, wherein the second feedback circuitry is operable to generate the VZTC by summing the fractional VBE with a quantity ΔVTH (delta voltage threshold), wherein the ΔVTH is developed across differential input transistors of the second feedback circuitry.

* * * * *